United States Patent [19]

Miyazaki et al.

[11] Patent Number: 4,611,560

[45] Date of Patent: Sep. 16, 1986

[54] IDLING SPEED CONTROL SYSTEM OF AN INTERNAL COMBUSTION ENGINE

[75] Inventors: Masaaki Miyazaki; Mitsuaki Ishii; Hajime Kako, all of Himeji; Noboru Nakamura, Kyoto; Hideo Kakinuma, Kusatsu, all of Japan

[73] Assignees: Mitsubishi Denki Kabushiki Kaisha; Mitsubishi Jidosha Kogyo Kabushiki Kaisha, both of Tokyo, Japan

[21] Appl. No.: 681,855

[22] PCT Filed: Apr. 7, 1984

[86] PCT No.: PCT/JP84/00175

§ 371 Date: Dec. 7, 1984

§ 102(e) Date: Dec. 7, 1984

[30] Foreign Application Priority Data

Apr. 8, 1983 [JP] Japan ..... 58-62530
Apr. 8, 1983 [JP] Japan ..... 58-62531

[51] Int. Cl.[4] ..... F02D 11/10
[52] U.S. Cl. ..... 123/339; 290/40 A
[58] Field of Search ..... 290/40 R, 40 A, 40 B, 290/40 C, 51; 123/339

[56] References Cited

U.S. PATENT DOCUMENTS 4,184,083 1/1980 Takeuchi ..... 290/40 C
4,395,985 8/1983 Hagen ..... 123/339
4,441,471 4/1984 Krah ..... 123/339
4,467,761 8/1984 Hasegawa ..... 123/339
4,491,108 1/1985 Hasegawa ..... 123/339

*Primary Examiner*—Ronald B. Cox
*Attorney, Agent, or Firm*—Leydig, Voit & Mayer, Ltd.

[57] ABSTRACT

The present invention is adapted for providing an idling speed control system of an internal combustion engine, which exhibits a good response for changes in an engine load, comprising: a throttle valve which controls the amount of intake air for the engine; an actuator which includes an electric motor for variably controlling the opening of the throttle valve; a rotation speed detector for detecting the rotation speed of the engine; an idling condition detector for detecting the idling condition of the engine; and a control, responsive to the detected output of the idling condition detector means, for generating feedback control pulses to intermittently drive said electric motor so that the detected rotation speed of the engine under the idling condition may converge into a target idling rotation speed while, responsive to the output of a detector that detects the operation condition of the engine load operated under the idling condition of the engine, or to the detected output of said rotation speed detector indicating that the detected rotation speed has dropped to an abnormally low rotation speed of the engine, for generating drive control pulses at a time independent of said feedback control pulses to drive said electric motor in a predetermined direction.

4 Claims, 8 Drawing Figures

IDLING SPEED CONTROL SYSTEM OF AN INTERNAL COMBUSTION ENGINE

TECHNICAL FIELD

The present invention relates to a system for controlling idling rotation speed of an internal combustion engine employed in an automobile or the like.

BACKGROUND ART

Some automobiles are equipped with an apparatus for controlling the idling rotation speed, by comparing the engine rotation speed under idling condition with a target idling rotation speed, changing the opening of a throttle valve depending upon the deviation therebetween so that the engine speed is controlled at a target rotation speed, thereby reducing the consumption of fuel under the idling condition.

Conventional apparatuses for controlling the idling speed use a cheaply constructed DC motor that works as an actuator to change the opening of the throttle valve, the DC motor being controlled in a rotating direction which corresponds to a speed deviation polarity between a target rotation speed and a practical rotation speed. To improve the control precision, furthermore, the DC motor is intermittently driven by intermittent feedback control pulses of a predetermined period, and the pulse width thereof is controlled depending upon the amount of the speed deviation. In this conventional apparatus, the pulse period is set so that the pulse pause interval hereinafter referred to as hold time becomes relatively long, by taking into consideration a snaking time of the DC motor and the delay time between the time when the opening of the throttle valve is changed and the time when the change of the engine speed is reflected thereby. Therefore, when it is expected that the engine rotation speed changes or drops abnormally due to the operation of loads such as an air-conditioning apparatus or a power steering appratus during a predetermined hold time, it is necessary to wait for the next pulse even when an estimated correction according to a pulse width correction is to be effected by detecting the operation of such loads. Accordingly, response for the change in the engine load is delayed possibly causing the engine to stall.

DISCLOSURE OF THE INVENTION

The present invention has been made in order to solve the above-mentioned problem, and its object is to provide an idling rotation speed control system of an internal combustion engine that exhibits a good response for changes in an engine load.

For this purpose, according to the present invention, provision is made of detection means to detect the operation condition of the engine load as operated under the idling condition or an abnormally low engine speed and a feedback control means to generate feedback control pulses of predetermined periods and holding time. The invention provides control means to generate control pulses responsive to abnormal changes in the operation condition or engine speed to change the opening of a throttle valve at a time independent of the generation of an ordinary feedback control pulse, and holding time.

BEST MODES FOR PRACTICING THE INVENTION

Figure 1:
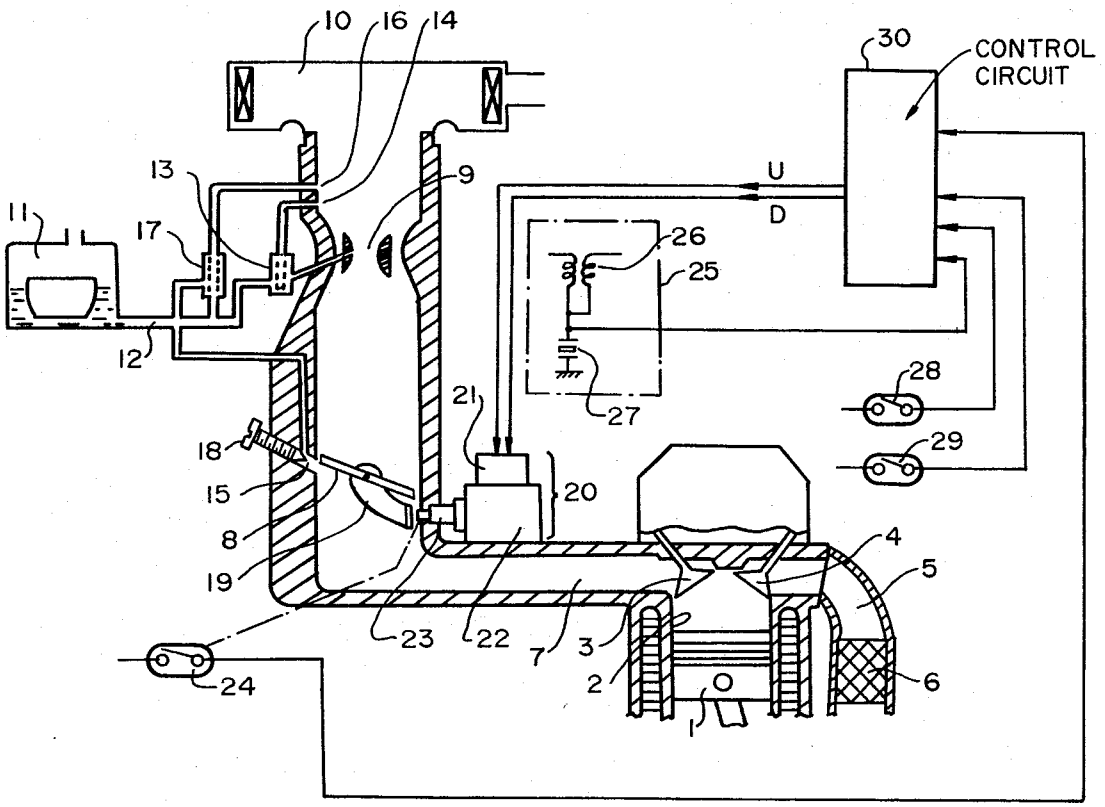
FIG. 1 is a structural diagram showing one embodiment of the present invention.

FIG. 1 is a structural diagram illustrating one embodiment of the present invention. In this figure, the structure of the engine will be described first. Reference numeral (1) denotes a piston, (2) denotes a cylinder, (3) denotes an intake valve, (4) denotes an exhaust valve, (5) denotes an exhaust pipe, (6) denotes a catalytic converter rhodium, (7) denotes an intake pipe, and (8) denotes a throttle valve. On the upstream side of the throttle valve (8), there are provided a venturi (9) and an air cleaner (10). The fuel in a float chamber (11) is sucked in and atomized via a main fuel path (12) as the air sucked in via the air cleaner (10) passes through the venturi (9) so that the mixture gas of the fuel and the intake air is introduced into the cylinder (2) through the throttle valve (8) and the intake pipe (7).

Here, a main air bleed (13) is provided in the main fuel path (12), and the fuel in the float chamber (11) is preliminarily divided into fine droplets by the air sucked in through a main air bleed path (14) formed on the upstream side of the venturi (9) and them atomized.

An idle port (15) is formed on the downstream side of the throttle valve (8), and further, a slow air bleed path (16) is provided on the upstream side of the venturi (9). The fuel in the main fuel path (12) is divided into fine droplets in the slow air bleed (17) by the air sucked in through the slow air bleed path (16), and is blown out of the idle port (15). This ensures the supply of the fuel maintained under the idling condition where the throttle valve (8) is almost closed. In this case, the amount of the fuel blown from the idle port (15) is adjusted by a slow adjust screw (18).

The throttle valve (8) is coupled to an accelerator pedal (not shown). When the automobile is running, the throttle valve is opened to a degree that corresponds to the amount by which the accelerator pedal is depressed while under the idling condition where the accelerator pedal is liberated, the throttle valve is opened to a degree (almost fully closed) that is necessary to maintain the idling operation condition. The throttle valve (8) is equipped with a level (19), on the rotary axis thereof, which is driven by an actuator (20) which will be hereinafter described, thereby varying the opening of the throttle valve under the idling condition.

Described herebelow is the structure of a system for controlling the idling speed. Reference numeral (20) denotes an actuator which consists of a DC motor (21) and a gear mechanism (22). The rotary motion of the DC motor (21) is converted by the gear mechanism (22)

into the linear motion of a plunger (23) which actuates the lever (19) to change the opening of the throttle valve (8). The DC motor (21) is supplied with a forward rotation control pulse U of a predetermined pulse width and with a reverse rotation control pulse D sent from a control circuit (30). The actuator (20) is provided with an idling condition detector switch (24) which turns on (closes) when the tip of the plunger (23) hits on the lever (19), i.e., under the idling condition where the accelerator pedal is liberated.

Reference numeral (25) denotes a rotation speed detector for detecting the engine rotation speed in which rotation pulse signals of a period corresponding to the engine rotation speed N are taken out of a connection point between an ignition coil (26) and an interrupter (27). Reference numeral (28) denotes an operation start switch (hereinafter abbreviated as A/C.S) of an air-conditioning apparatus which is one of the engine loads, (29) denotes a transmission switch which detects that the transmission (not shown) is at the neutral position or that the clutch (not shown) is engaged (trod in), namely that the engine is disconnected from the wheels, and (30) denotes a control circuit which controls the opening of the throttle valve under the idling condition relying upon signals produced by the idling switch (24) which detects the idling condition, produced by the speed detector 25, produced by the A/C.SW (28), and produced by the transmission switch (29), such that the engine rotation speed converges into a target rotation speed $N_O$.

Figure 2:
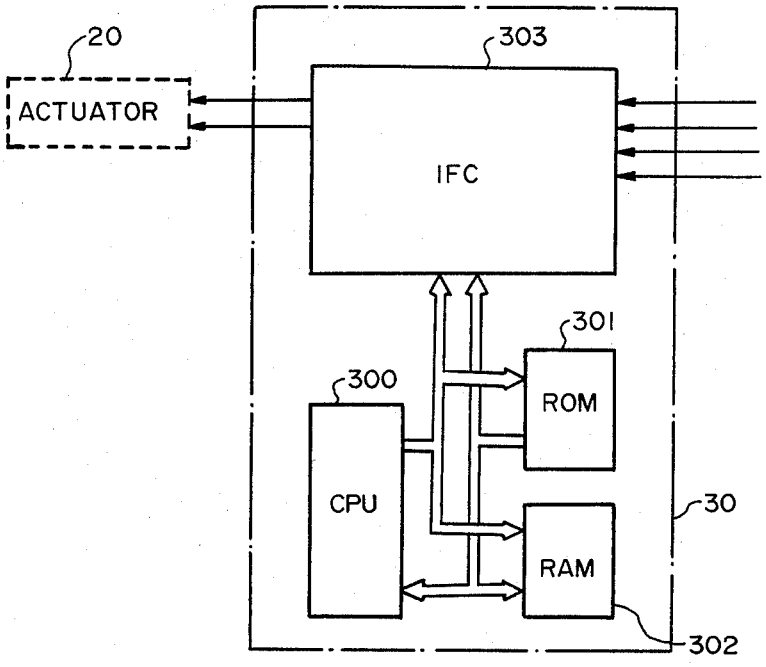
FIG. 2 is a block diagram illustrating the detailed structure of a control circuit.

The control circuit (30) consists, as shown in FIG. 2, of an operation processing unit (hereinafter abbreviated as CPU) (300), a read-only memory (hereinafter abbreviated as ROM) (301) which stores a program for controlling the idling speed and stores constants etc., a random access memory (hereinafter abbreviated as RAM) (302) which stores an interim result of arithmetic operation etc., and an interface circuit (hereinafter abbreviated as IFC) (303) for transmitting and receiving signals between the above-mentioned various switches and the actuator (20).

The operation of the above-mentioned structure will now be described with reference to flow charts shown in FIGS. 3 and 4.

Figure 3:
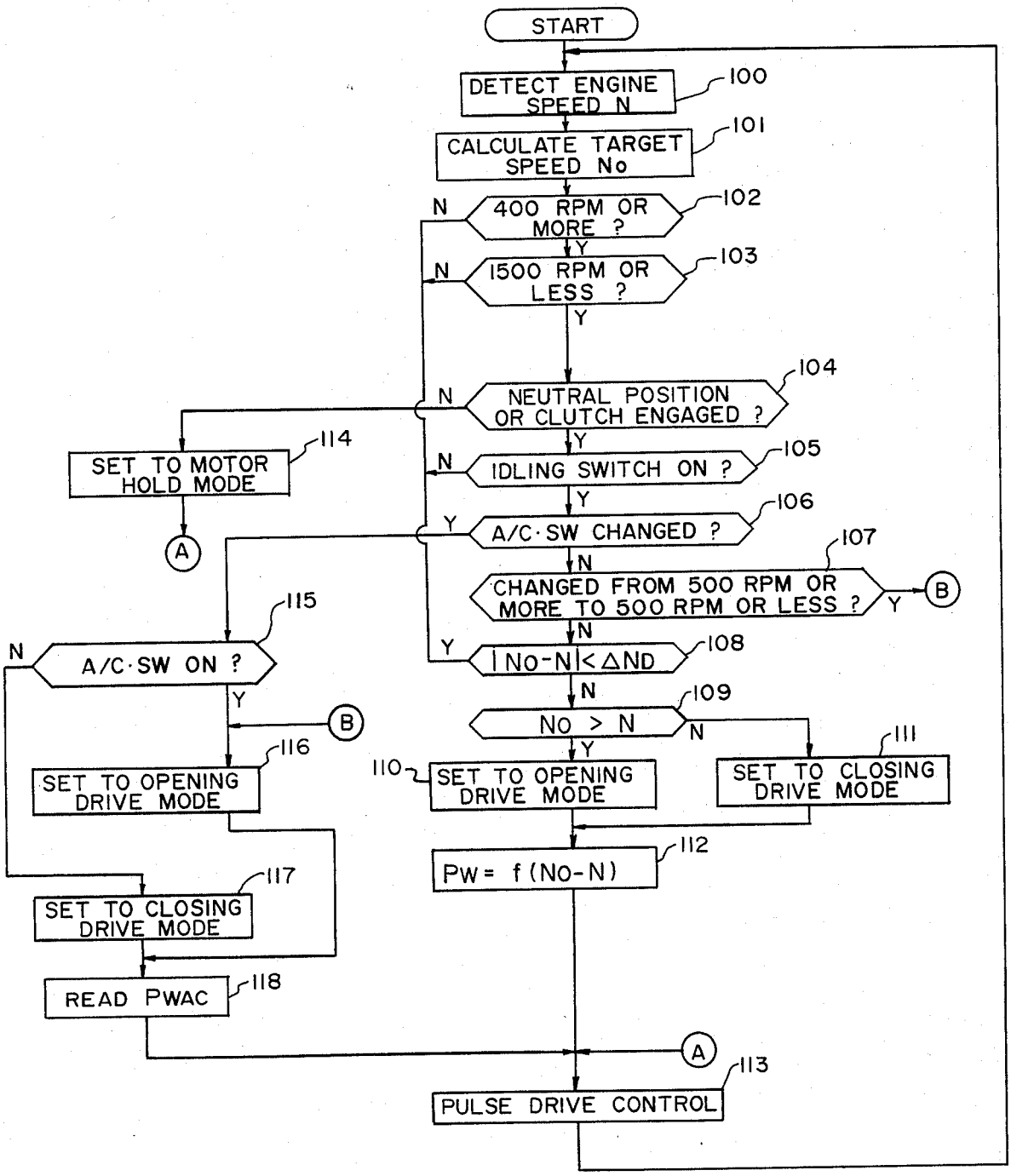
FIG. 3 is a flow chart illustrating the operation contents of the control circuit.

First, as the engine is started, the CPU (300) executes such a processing as shown in FIG. 3 in accorddance with the program stored in the ROM (301). That is, the CPU (300) receives output signals of the speed detector (25) and measures the period of said signals to detect the present engine rotation speed N (step 100), and then calculates the target rotation speed $N_O$ under the idling condition (step 101). The target rotation speed $N_O$ under the idling condition varies depending upon whether or not the air-conditioning apparatus is in operation, and has been determined as shown, for example, in Table 1.

TABLE 1

| Air-conditioning apparatus | Target idling rotation speed |
|---|---|
| ON (operation) | 900 RPM |
| OFF (non-operation) | 700 RPM |

This target idling rotation speed $N_O$ has been stored beforehand as a constant in the ROM (301). Therefore, the calculation of the target idling rotation speed $N_O$ is effected by reading the above constant out of the ROM (301).

Next, the CPU (300) discriminates in steps (102) and (103) whether or not the engine speed N lies in a controlled range of 400 RPM to 1500 RPM. When the engine speed does not lie within the controlled range, in step (114) the drive mode of the actuator (20) is set to the hold mode so that no control is executed for the actuator (20). When the engine speed N lies within the controlled range of from 400 RPM to 1500 RPM, however, step (104) discriminates whether or not the transmission switch (29) is on i.e., whether or not the transmission is at the neutral position, or whether or not the clutch is engaged, based on the output signal of the transmission switch (29), and thereafter, the next step (105) discriminates whether or not the idling detector switch (24) is on. As a result, when the transmission switch (29) is found to be off, it is assumed that the automobile is running so that in step (114) the drive mode is set to the hold mode. When the idling detector switch (24) is made off even under the condition where the transmission switch is on, it is assumed that the driver is operating the accelerator pedal so that in step (114) the drive mode is set to the hold mode. In either case, no control is executed for the actuator (20).

However, when the transmission switch (29) is on (neutral condition or the clutch being engaged) and when the idling detector switch (24) is on, it is assumed that a main fuel is supplied to the engine through the idle port (15) or that the engine is under the idling condition so that the next step (106) is to discriminate whether or not the A/C.SW (28) has changed from on to off or from off to on. As a result, if there is no change in the state of the A/C.SW (28), in the next step (107) whether or not the engine speed N has dropped from a value of 500 RPM or more to an abnormally small value of 500 RPM or less is discriminated. As a result, if the engine rotation speed has not dropped to the abnormally small value, in the next step (108) a deviation (absolute value) between the target rotation speed $N_O$ and the present engine rotation speed N is determined, and further whether or not the deviation is greater than a predetermined value $\Delta N_D$ is detected. When the deviation is smaller than $\Delta N_D$, in step (114) the drive mode of the actuator (20) is set to the hold mode. However, when the deviation is greater than the predetermined value $\Delta N_D$, the processing is executed in the subsequent steps (109) to (113) to converge the engine speed N into the target rotation speed $N_O$.

Figure 5:
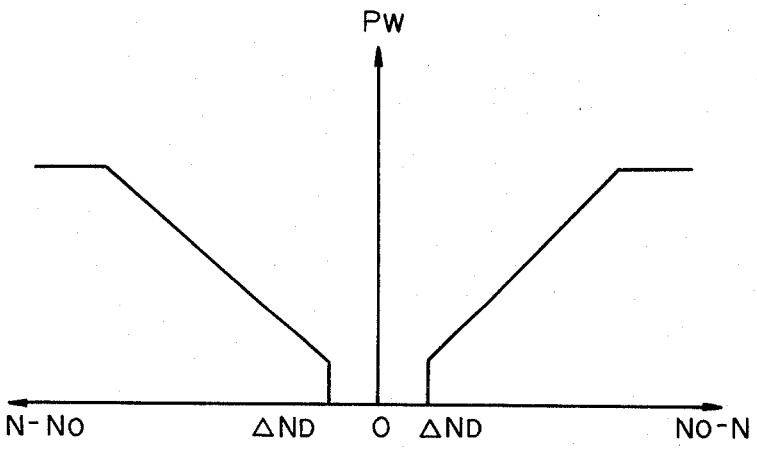
FIG. 5 is a graph showing one example of an actuation time of an actuator in relation to the deviation between a target engine speed and an engine speed.

Namely, in step (109), the present engine rotation speed N is compared with the target rotation speed $N_O$. If $N_O > N$, the opening of the throttle valve (8) is required to be controlled so as to open. Therefore, the drive mode of the actuator (20) is set to an opening mode. Conversely, if $N_O < N$, the opening of the throttle valve (8) is required to be controlled so as to close. Accordingly, the drive mode of the actuator (20) is set to a closing mode. Then, in step (112), a drive time data $P_W$ of the actuator (20) corresponding to the deviation $(N_O - N)$ between $N_O$ and N is read out of the ROM (301). The relationship between the drive time data $P_W$ and the deviation $(N_O - N)$ has been so determined that the drive time data $P_W$ increases nearly in proportion to the increase in the deviation $(N_O - N)$ or $(N - N_O)$ as shown in FIG. 5.

Thus, as there is obtained the drive time data $P_W$ of actuator (20) corresponding to the deviation between the idling target rotation speed $N_O$ and the present engine rotation speed N, in step (113) the CPU (300) causes the IFC (303) to generate the forward rotation control pulse U or the reverse rotation control pulse D to drive the actuator (20) only for a period of the drive time data $P_W$ in the direction corresponding to the drive mode. In this case, the forward rotation control pulse U is generated when the drive mode indicates the opening direction while the reverse rotation control pulse D is generated when the drive mode indicates the closing direction.

Therefore, the throttle valve (8) is controlled and set in a direction corresponding to the target idling rotation speed $N_O$, and the engine rotation speed N converges into the target rotation speed $N_O$. Thereafter, the CPU (300) repeates the processing starting with step (100) and causes a control pulse corresponding to the change in the rotation speed at that moment after a fixed hold time $T_H$ has lapsed.

Thus, the engine rotation speed N is maintained at the target rotation speed $N_O$ by such opening and opening controls of the throttle valve (8), that is feedback control, corresponding to the deviation between the target rotation speed $N_O$ and the engine rotation speed N.

However, when the A/C.SW (28) has changed from on to off or from off to on, the CPU (300) detects this change in step (106). In step (115), a further detection is made to determine whether or not this change is from on to off or vice versa. If this change is toward the on-state, the drive mode of the actuator (20) is set to the opening drive mode (step 116). On the other hand, if this change is toward the off-state, the drive mode is set to the closing drive mode (step 117). Then, in the next step (118) a rotation speed change caused by the increase or decrease of the engine loads due to the start operation or the stop operation of the air-conditioning apparatus is estimated to read out of the ROM (301) the drive time data $P_{WAC}$ of actuator (20) that corresponds to the estimated change in the loads. Then, in step (113) the IFC (303) is caused to generate the forward rotation control pulse U or the reverse rotation control pulse D to drive the actuator (20) only for a period of the drive time data $P_{WAC}$ in the direction corresponding to the drive mode.

Therefore, at a moment when the air-conditioning apparatus starts its operation, the opening of the throttle valve (8) is opened by a degree which corresponds to the drive time data $P_{WAC}$ whereas at a moment when the air-conditioning apparatus stops its operation, the opening of the throttle valve (8) is closed by a degree corresponding to the data $P_{WAC}$.

After having effected such an estimated control, the CPU (300) works to converge the idling speed into the target rotation speed $N_O$ by means of the feedback control through steps (100) to (112).

Figure 4:
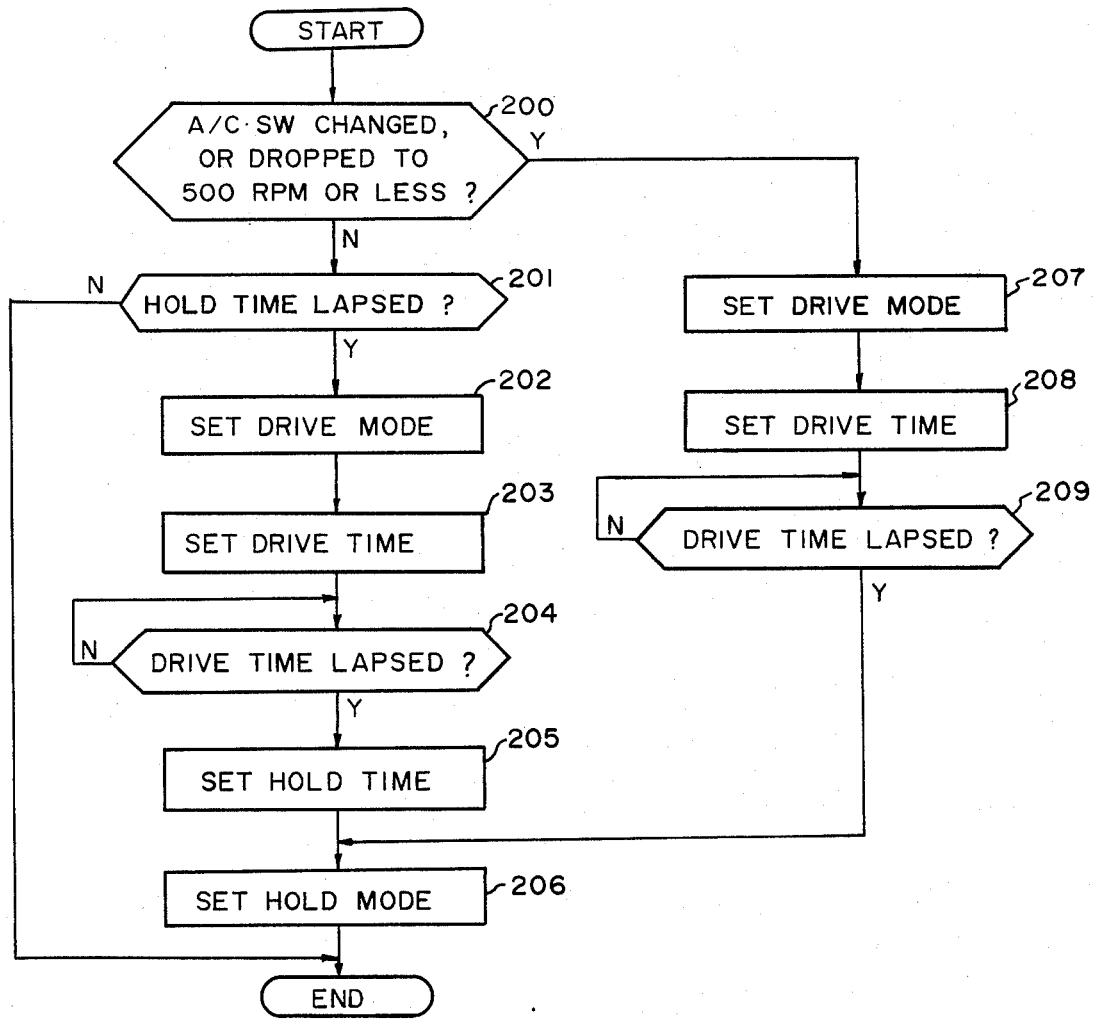
FIG. 4 is a time chart illustrating a first embodiment of a pulse drive control step (113) of FIG. 3.

In this case, the processing steps of the pulse drive control in step (113) are arranged as shown in the flow chart of FIG. 4, in which, at a time when the operation of the air-conditioning apparatus is started or stopped, the actuator (20) is immediately driven to effect the estimated control without waiting for the lapse of the predetermined hold time $T_H$.

Namely, in FIG. 4, when an ordinary feedback control without any change in the A/C.SW (28) is being carried out, the process of the CPU (300) passes through the judgement of step (200) and detects in step (201) whether or not the predetermined hold time $T_H$ has lapsed. When the hold time has not lapsed, the processes of the steps (100) to (113) are repetitively executed. When it is detected that the predetermined hold time $T_H$ has lapsed, in step (202) the drive mode of the actuator (20) is set to the opening mode or the closing mode. Then, in step (203) the drive time data $P_W$ determined by step (112) of FIG. 3 is set in a register for timer in the RAM (302), so that the forward rotation control pulse U or the reverse rotation control pulse D corresponding to the drive mode begins to be generated from the IFC (303). Then, the next step (204) is to determine whether or not the time for generating the control pulse U or D has lapsed, i.e., whether or not the drive time of the actuator (20) has reached $P_W$. When the drive time has reached that, the generation of the control pulse U or D is stopped. Then, in step (205), the predetermined hold time $T_H$ is set in the register for timer, and in the next step (206), the drive mode is set to the hold mode, so that the process proceeds to step (100) of FIG. 3. This causes, under the ordinary feedback control, the actuator (20) to be intermittently driven by control pulses with the pause interval of the predetermined hold time $T_H$ whereby the engine rotation speed N is converged into the target rotation speed $N_O$.

However, when the A/C.SW (28) had changed into on or off, the process of the CPU (300) passes through the judgement of step (200) and in step (207) the drive mode of actuator (20) is set to the mode determined by step (116) or (117) of FIG. 3, and then in the next step (208) the drive time data $T_{WAC}$ determined by step (118) of FIG. 3 is set in the register for timer to cause the IFC (303) to start to generate the forward rotation control pulse U or the reverse rotation control pulse D corresponding to the drive mode. After it is detected in the next step (209) that the drive time has lapsed, the drive mode is set to the hold mode, and the process proceeds to step (100) of FIG. 3. This causes, when the A/C.SW (28) changes its state, the actuator (20) to be immediately driven without waiting for the lapse of the predetermined hold time $T_H$.

Figure 6:
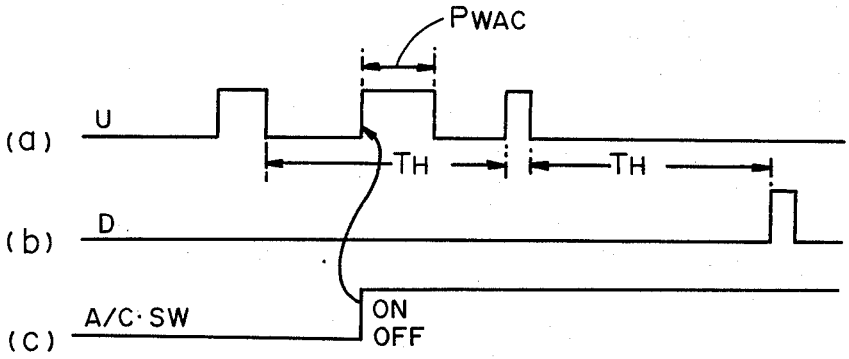
FIG. 6 is a time chart showing one example of a control pulse that is generated when an air-conditioning apparatus starts to perate.

Therefore, when the A/C.SW (28) has changed, for example, from off to on, the forward revolution control pulse U is generated in the middle of the hold time $T_H$ as shown in FIG. 6.

On the other hand, the same estimated control is carried out even when the engine rotation speed N has abnormally dropped to 500 RPM or less, the CPU (300) sets in step (116) the drive mode of the actuator (20) to the opening drive mode where the throttle valve (8) is opened, and then, in step (118), reads the drive time data $P_{WAC}$ out of the ROM (301). Then, passing through the judgement of step (200) of FIG. 4, the processes of steps (207) to (209) are executed. The throttle valve (8) is thereby opened by an opening that corresponds to the drive time data $P_{WAC}$. Consequently, the engine rotation speed N is immediately restored in its increasing direction.

According to this embodiment as described above, the engine rotation speed can be converged into a target rotation speed in quick response to variations in the engine loads or changes into an abnormally dropped speed, making it possible to prevent the engine rotation speed from quickly changing or from going into halt. Further, since use is made of a cheaply constructed DC motor as an actuator to control the opening of the throttle valve, the engine rotation speed can be converged into the target rotation speed at a low cost and with a good precision owing to an intermittent control.

Figure 7:
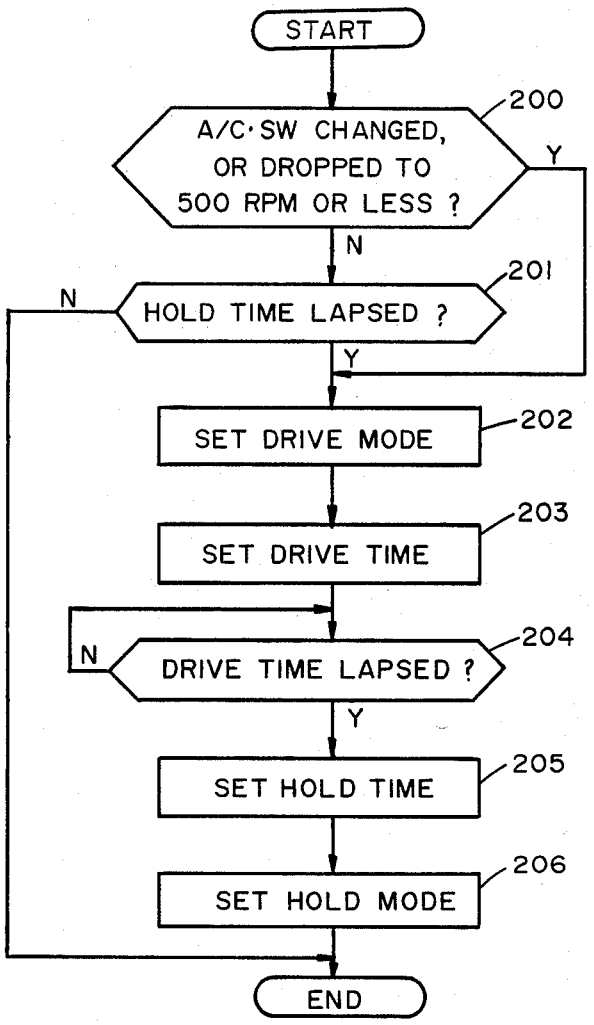
FIG. 7 is a flow chart illustrating a second embodiment of a pulse drive control step (113) corresponding to FIG. 4.

FIG. 7 is a flow chart illustrating a second embodiment of the present invention, showing a portion of the pulse control step (113) that corresponds to FIG. 4 of the first embodiment.

Also in the case of the second embodiment, operations relates to FIG. 3 are the same as the aforementioned operations and so the descriptions thereof are omitted. What makes the embodiment of FIG. 7 different from the embodiment of FIG. 4 is that when the A/C.SW (28) changes into on or off or when the engine rotation speed drops to 500 RPM or less, the control pulse $P_{WAC}$ is generated independently of the feedback control pulse while the time for generating the feedback control pulse that is generated next to the independent control pulse $P_{WAC}$ is retarded behind the above pulse $P_{WAC}$ by a predetermined period of time, so that the feedback control pulse $P_W$ and the control pulse $P_{WAC}$ will not be concurrently generated.

Herebelow is described in detail the operation when the A/C.SW (28) changes into on or off, or when the engine rotation speed drops to 500 RPM or less. The operation under the ordinary feedback control is the same as that of FIG. 4, and so the descriptions thereof are omitted.

When the A/C.SW (28) changes into on or off, the process of the CPU (300) passes through step (200) and proceeds to step (202) irrespective of whether or not the hold time $T_H$ has lapsed. In step (202), the drive mode of actuator (20) is set to the mode determined by step (116) or (117) of FIG. 3, and then in the next step (203) the drive time data $T_{WAC}$ determined by step (118) of FIG. 3 is set in the register for timer, thereby causing the IFC (303) to initiate the generation of the forward rotation control pulse U or the reverse rotation control pulse D corresponding to the drive mode. Then, in the next step (204), the lapse of the drive time is detected, then in step (205), the predetermined hold time $T_H$ is set in a register for timer, and then in the next step (206), the drive mode is set to the hold mode. The process then proceeds to step (100) of FIG. 3.

Therefore, when the A/C.SW (28) changes, for example, from off to on, the forward revolution control pulse U is generated in the middle of the hold time $T_H$ as shown in FIG. 6.

Also when the engine rotation speed N becomes an abnormally dropped speed of 500 RPM or less, the estimated control is effected in the same manner. That is, as the CPU (300) detects in step (107) of FIG. 3 that the engine rotation speed N has dropped to 500 RPM or less, it sets, in step (116), the drive mode of actuator (20) to the opening mode where the throttle valve (8) is to be opened and then in step (118), reads the drive time data $P_{WAC}$ out of the ROM (301). Then, passing through the judgement of step (200) of FIG. 4, the processing of steps (202) to (206) is executed. The throttle valve (8) is thereby opened by an opening that corresponds to the drive time data $P_{WAC}$. Consequently, the engine rotation speed N is immediately restored in its increasing direction.

Figure 8:
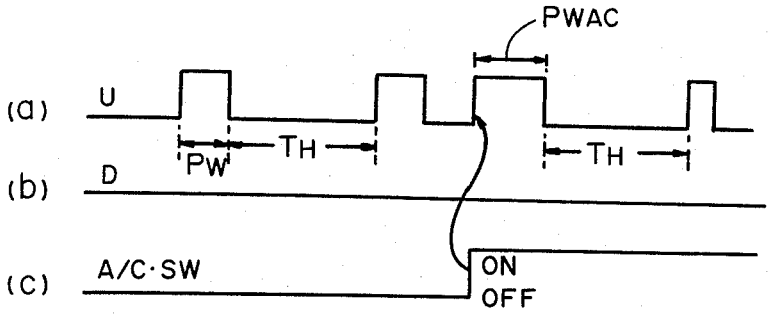
FIG. 8 is a time chart showing a control pulse according to the second embodiment.

In this case, the CPU (300) under program control provides control means responsive to the output of the detector 25 that detects an abnormally low speed of the engine for generating a control pulse which is transmitted to the actuator 20 and, after such an estimated control has been executed, the predetermined hold time $T_H$ is set again in step (205). Therefore, the forward rotation control pulse U or the reverse rotation control pulse D by means of the feedback control (control through steps (109) to (112) of FIG. 3) after the estimated control, is inhibited from being generated until the hold time $T_H$ as set again has lapsed as shown in the time chart of FIG. 8. Namely, under a transient response condition of the engine due to the estimated control, the feedback control is inhibited for the predetermined period of time $T_H$, and is started after the predetermined period of time has passed. This makes it possible to avoid the overlapping of the estimated control and the feedback control so that a contrary effect such as a rapid change due to the overlapping of both controls can be prevented. Moreover, the controlled variable by the estimated control can be set independently of the feedback control.

According to this embodiment as described above, the engine rotation speed can be converged into a target rotation speed in quick response to changes in the engine loads or changes into an abnormally low rotation speed so that the engine rotation speed can be prevented from quickly changing or from going into halt. Further, since a DC motor is used as an actuator to control the opening of the throttle valve, the engine rotation speed can be converged into a target rotation speed at a low cost and with a good precision owing to an intermittent control. Further, it is possible to avoid the overlapping of the estimated control and the feedback control. Therefore, a contrary effect such as a rapid change of the engine rotation speed due to the overlapping of both controls can be prevented, and the engine rotation speed can be converged into a target rotation speed precisely and quickly.

Although the foregoing description has dealt with the case where an air-conditioning apparatus is exemplified as an engine load, the invention can be similarly put into practice even in the case of a power steering apparatus or the like.

INDUSTRIAL APPLICABILITY

The present invention can be adapted not only for the control of the internal combustion engine of an automobile but also for the control of the internal combustion engines of other industrial machineries.

We claim:

1. An idling speed control system of an internal combustion engine comprising:
   - a valve device which controls the amount of intake air for the engine;
   - an actuator which includes an electric motor for variably controlling the opening of said valve device;
   - rotation speed detector means for detecting the rotation speed of the engine;
   - idling condition detector means for detecting the idling condition of the engine;
   - feedback control means responsive to the detected output of said idling condition detector means for generating feedback control pulses to intermittently drive said electric motor so that said detected rotation speed of the engine under the idling condition may converge into a target idling rotation speed; and
   - control means responsive to the output of detector means that detects an abnormally low rotation speed of the engine detected by said rotation speed detector means for generating control pulses that do not overlap said feedback control pulses to drive said electric motor in a predetermined direction.

2. An idling speed control system of an internal combustion engine comprising:

a valve device which controls the amount of intake air for the engine;

an actuator which includes an electric motor for variably controlling the opening of said valve device;

rotation speed detector means for detecting the number of revolutions of the engine;

idling condition detector means for detecting the idling condition of the engine;

engine load condition detector means for detecting the operation condition of an engine load under the idling condition of said engine;

feedback control means responsive to the detected output of said idling condition detector means for generating feedback control pulses to intermittently drive said electric motor so as to converge said detected rotation speed of the engine under the idling condition into a target idling rotation speed;

first control means responsive to an operation condition of an engine load under the idling condition of the engine detected by said engine load condition detector means for generating drive control pulses at a time such that said drive pulses do not overlap said feedback control pulses to drive said electric motor in a predetermined direction; and second control means for determining the time of the generation of said feedback control pulses relative to the generation of said drive control pulses such that said feedback control pulses are generated at a predetermined time from the generation of said drive control pulses.

3. An idling speed control system of an internal combustion engine comprising:

a valve device which controls the amount of intake air for the engine;

an actuator which includes an electric motor for variably controlling the opening of said valve device;

rotation speed detector means for detecting the rotation speed of the engine;

idling condition detector means for detecting the idling condition of the engine;

feedback control means responsive to the detected output of said idling condition detector means for generating feedback control pulses to intermittently drive said electric motor so as to converge said detected rotation speed of the engine under the idling condition into a target idling rotation speed;

first control means responsive to an abnormally low rotation speed of the engine detected by said rotation speed detector means for generating drive control pulses at a time such that said drive pulses do not overlap said feedback control pulses to drive said electric motor in a predetermined direction; and second control means for determining the time of the generation of said feedback control pulses relative to the generation of said drive control pulses such that said feedback control pulses are generated at a predetermined hold time from the generation of said drive control pulses.

4. An idling speed control system of an internal combustion engine according to claim 2, wherein the engine load comprises an air-conditioning apparatus.

* * * * *